US010712078B2

(12) United States Patent
Jensen

(10) Patent No.: US 10,712,078 B2
(45) Date of Patent: Jul. 14, 2020

(54) DEFROST SYSTEM

(71) Applicant: SCANTEC REFRIGERATION TECHNOLOGIES PTY. LTD., Murarrie (AU)

(72) Inventor: Stefan Jensen, Murarrie (AU)

(73) Assignee: SCANTEC REFRIGERATION TECHNOLOGIES PTY. LTD., Murarrie, Queensland (AU)

( * ) Notice: Subject to any disclaimer, the term of this patent is extended or adjusted under 35 U.S.C. 154(b) by 0 days.

(21) Appl. No.: 15/779,400

(22) PCT Filed: Mar. 24, 2017

(86) PCT No.: PCT/AU2017/050267
§ 371 (c)(1),
(2) Date: May 25, 2018

(87) PCT Pub. No.: WO2017/161425
PCT Pub. Date: Sep. 28, 2017

(65) Prior Publication Data

US 2019/0072311 A1 Mar. 7, 2019

(30) Foreign Application Priority Data

Mar. 24, 2016 (AU) ..... 2016901111

(51) Int. Cl.
*F25D 21/12* (2006.01)
*F25B 23/00* (2006.01)
(Continued)

(52) U.S. Cl.
CPC ..... *F25D 21/12* (2013.01); *F25B 23/006* (2013.01); *F25B 1/10* (2013.01); *F25B 9/008* (2013.01);
(Continued)

(58) Field of Classification Search
CPC ..... F25B 23/006; F25B 47/02; F25B 1/10; F25B 9/008; F25B 2400/072;
(Continued)

(56) References Cited

U.S. PATENT DOCUMENTS 4,336,692 A 6/1982 Ecker et al.
4,660,384 A * 4/1987 Pallanch ..... F25B 47/022 62/151
(Continued)

FOREIGN PATENT DOCUMENTS

DE 25 03 303 A1 8/1975
EP 2 940 408 A1 11/2015
(Continued)

OTHER PUBLICATIONS

International Search Report issued in PCT/AU2017/050267 dated Jun. 15, 2017 (3 pages).
(Continued)

*Primary Examiner* — Joseph F Trpisovsky
(74) *Attorney, Agent, or Firm* — Brinks Gilson & Lione; John C. Freeman

(57) ABSTRACT

Disclosed is a defrost system (200) comprising a refrigeration cycle (202) and defrost cycle (204), and a first heat exchanger (206) and a second heat exchanger (208). The first heat exchanger (206) exchanges heat between the defrost cycle (204) and a heat source (210) whereby the defrost fluid of the defrost cycle may undergo at least a partial phase change in the first heat exchanger. The second heat exchanger (208) exchanges heat between one or more components of the refrigeration cycle (202) and the defrost cycle (204).

13 Claims, 3 Drawing Sheets

(51) Int. Cl.
*F25B 1/10* (2006.01)
*F25B 9/00* (2006.01)

(52) U.S. Cl.
CPC ..... *F25B 2309/06* (2013.01); *F25B 2400/072* (2013.01)

(58) Field of Classification Search
CPC ..... F25B 47/022; F25B 2347/02; F25B 2347/021; F25B 2347/022; F25D 21/12; F25D 21/06; F25D 21/00; F25D 2321/14
USPC ..... 62/278
See application file for complete search history.

(56) References Cited

U.S. PATENT DOCUMENTS

| | | | | |
|---|---|---|---|---|
| 5,400,615 | A | 3/1995 | Pearson | |
| 8,091,372 | B1 * | 1/2012 | Ekern | F25B 13/00 62/129 |
| 9,605,883 | B2 | 3/2017 | Katoh et al. | |
| 2014/0260364 | A1 | 9/2014 | Litch | |
| 2014/0318170 | A1 | 10/2014 | Katoh et al. | |
| 2018/0156523 | A1 * | 6/2018 | Park | F25B 39/022 |

FOREIGN PATENT DOCUMENTS

| | | | |
|---|---|---|---|
| GB | 2 258 298 | A | 2/1993 |
| JP | 2010-181093 | A | 8/2010 |
| JP | 2013-124812 | A | 6/2013 |
| WO | WO 2009/034300 | A1 | 3/2009 |
| WO | WO 2016/064200 | A2 | 4/2016 |

OTHER PUBLICATIONS

International Preliminary Report on Patentability issued in PCT/AU2017/050267 dated Apr. 16, 2018 (7 pages).
Extended European Search Report (7 pages) out of corresponding European Application No. 17769194.6.

* cited by examiner

DEFROST SYSTEM

This application is a National Stage application of International Application No. PCT/AU2017/050267, filed Mar. 24, 2017, the entire contents of which are incorporated herein by reference.

Applicant claims, under 35 U.S.C. § 119, the benefit of priority of the filing date of Mar. 24, 2016 of an Australian patent application, copy attached, Serial Number 2016901111, filed on the aforementioned date, the entire contents of which are incorporated herein by reference.

TECHNICAL FIELD

This disclosure relates to a defrost system that may be used, for example, to defrost one or more components (e.g. evaporator coils, tundish, etc.) of a refrigeration system.

BACKGROUND OF THE INVENTION

Refrigeration systems, such as those used to refrigerate cold rooms, are susceptible to frost build up on e.g. the evaporator coils of such systems (although frost is not limited to this part of the system).

One way to remove this frost is to use a hot gas defrost system. In existing hot gas defrost systems, refrigerant vapour from the compressor discharge or high pressure receiver of the refrigeration system is diverted through the evaporator coils. The hot vapour condenses in the evaporator coils, thereby releasing heat and causing the frost to melt. This type of system can result in large energy losses due to more condensing energy being released than is needed for frost removal, and requires a large reservoir for accommodating the condensate formed during defrost. This type of system also conveys refrigeration machine oil contained in the compressor discharge to the evaporators being defrosted. This is undesirable because it can result in oil fouling within the evaporators that, in turn, results in a reduction in efficiency of the coils and the system. In cases where the refrigerant is toxic, flammable or environmentally harmful, it is desirable to minimise the system's refrigerant inventory. For example, accidents associated with known hot gas defrost systems have been caused by phenomena such as liquid hammer, hydraulic shock and subsequent pipe rupture.

Defrost systems that do not necessarily increase the system's refrigerant inventory are known. These are, for example, electric defrost, ambient air defrost and water defrost. Electric defrost uses high grade energy for a simple heating purpose. This type of defrost is often highly inefficient and unreliable (requiring frequent heater replacement). On the other hand, ambient air defrost can be efficient, but is dependent on climatic conditions and system design (and is thus not always possible). Similarly, water defrost can be efficient but can also malfunction, causing water damage in the refrigerated space (e.g. warehouse) as a result of drain pan overflows not being recognised in time.

A further type of defrost system is a warm glycol defrost system. This type of system consists of a glycol tank that is warmed by a discharge gas (of the refrigeration system). When the defrost system is activated, warm glycol is pumped (by a separate circulation pump) through the evaporator and drip tray of the refrigeration system in glycol tubes that are separate to the refrigeration system. In general, the film coefficient between the glycol and internal surfaces of the glycol tubes at the evaporator is relatively low. This is compensated for by way of elevated glycol inlet temperatures. However, the requirement for elevated inlet temperatures precludes the use of low grade heat sources (e.g. having temperatures of 5° C. to 10° C. above the freezing point of water) in these types of defrost systems.

The above references to the background art do not constitute an admission that the art forms part of the common general knowledge of a person of ordinary skill in the art. The above references are also not intended to limit the application of the defrost system, refrigeration system and method as disclosed herein.

SUMMARY

Disclosed herein is a defrost system for defrosting one or more components of a refrigeration system. The defrost system comprises a first heat exchanger configured to exchange heat from a heat source to a defrost fluid to cause the defrost fluid to at least partially change phase. The system further comprises a second heat exchanger configured to receive heated defrost fluid from the first heat exchanger, and to exchange heat from the heated defrost fluid to the one or more components of the refrigeration system to at least partially defrost the one or more components.

The defrost system is generally separate from the refrigeration system. In other words, the defrost fluid and refrigerant do not directly mix at any point, nor do they share the same conduits or vessels. This is in contrast to known hot gas defrost systems whereby refrigeration fluid from the compressor is redirected to the evaporator (i.e. the refrigerant and defrost fluids are within the same system). Further, and unlike warm glycol systems, the defrost fluid may be driven through the defrost circuit by phase change, which may completely avoid the need for a pump or may reduce pump requirements.

Such an arrangement may also reduce refrigerant charge, and may provide the possibility of integrating a low charge intercooler between the first stage and second stage compressors. A lower refrigerant charge may be desirable with respect to safety and environmental considerations. A further safety benefit may be the reduction of liquid hammer (and associated pipe ruptures) through the simplified management of defrost fluid being discharged from the second heat exchanger.

In some cases, where a high density defrost fluid (e.g. $CO_2$) is used, the second heat exchanger and the defrost fluid piping can be more compact. In this respect, the defrost system may require less space to install.

The arrangement of the defrost system may also provide the possibility of using heat sources external to the refrigeration system, which can avoid the problem of defrost fluid shortages when too much evaporator surface area of the plant requires defrosting.

Further, the use of the separate phase change defrost fluid system (i.e. without using the refrigerant as the defrost fluid) can provide rapid release of defrost energy in the second heat exchanger. This rapid release of energy may provide efficiency improvements over known hot gas defrost systems. The separated nature of the defrost system may also allow the defrost heat to be supplied from a place within the primary refrigeration system where the vapour compression cycle may benefit (e.g. sub-cooling of condensed refrigerant as discussed further below).

In one embodiment the defrost fluid may be vapourised in the first heat exchanger. In this respect, and as is set forth above, the flow of defrost fluid from the first heat exchanger (e.g. to the defrost fluid vessel or the remainder of the system) may be facilitated by density changes (e.g. caused by a phase change in the defrost fluid).

In one embodiment, the heated defrost fluid received in the second heat exchanger may be in the form of a saturated vapour or a mixture of saturated vapour and liquid (e.g. of any quality).

In one embodiment, the defrost fluid may at least partially undergo a phase change or phase transition in the second heat exchanger. The defrost fluid may at least partially condense in the second heat exchanger. The condensation of the defrost fluid in the defrost tubes of the second heat exchanger may (in some arrangements) result in a high film (or heat transfer) coefficient relative to non-phase change arrangements.

In one embodiment the defrost fluid may circulate between the first and second heat exchangers as a result of density changes in the defrost fluid. The changes in density of the defrost fluid may manifest as the defrost fluid having different densities at the first and second heat exchangers. This can result in circulation of the defrost fluid. In this respect, the defrost fluid, in one embodiment, may circulate as a result of a thermosiphon effect, mechanism or process. The defrost fluid may, in this regard, be able to circulate without external equipment such as e.g. pumps.

In one embodiment, the second heat exchanger may be elevated with respect to the first heat exchanger. This may facilitate circulation between the first and second heat exchangers, especially when driven by way of density differentials. The elevation of the second heat exchanger, with respect to the first heat exchanger, may be such that the pressure drops and pressure gains of the defrost fluid in the defrost system are in equilibrium. In one embodiment, the system may be arranged such that this equilibrium establishes of itself. That is, in some embodiments, the first heat exchanger may naturally compensate for a large height difference between the first and second heat exchangers (which may result in a significant driving force and consequently high liquid component in the defrost fluid flowing from the second heat exchanger to the first heat exchanger) by increased boiling of the defrost fluid, which may result in larger pressure drops in the system and an increase in the vapour components in the second heat exchanger.

In one embodiment the heat source may comprise a heating fluid flowing through the first heat exchanger. The heating fluid may comprise glycol. The heating fluid may be at least partially heated by waste heat from the refrigeration system. Alternatively or additionally, the heating fluid may be at least partially heated by a subfloor heating system. The waste heat may be from elsewhere in a facility.

In one embodiment the heating fluid may be a refrigerant of the refrigeration system. In this way, heat lost from the refrigeration system may be used to defrost the components of the refrigeration system. The refrigerant when employed as a heat source may be a condensate of the refrigeration system.

In one embodiment the refrigerant may be sub-cooled in the first heat exchanger. The sub-cooling may be a result of heat being transferred from the condensate to the defrost fluid in the first heat exchanger. The sub-cooling of the refrigerant may increase the enthalpy difference between the refrigerant fluid supplied to evaporators in the system that are not undergoing a defrost process and the refrigerant vapour returning to the compressor from these evaporators. This increase in enthalpy difference may occur without any increase in the power absorbed by the compressor of the refrigeration system and thus may provide an efficiency increase.

In one embodiment the defrost system may further comprise an intermediary defrost fluid vessel for storage of defrost fluid. The defrost fluid vessel may be in fluid communication with and between the first and second heat exchangers. The defrost fluid vessel may comprise a first defrost fluid inlet for receipt of heated defrost fluid from the first heat exchanger; a first defrost fluid outlet for transfer of heated defrost fluid to the second heat exchanger; a second defrost fluid inlet for receipt of defrost fluid from the second heat exchanger; and a second defrost fluid outlet for transfer of defrost fluid to the first heat exchanger. The fluid vessel may allow the defrost fluid to be stored (e.g. as a gas) such that when defrosting of the refrigeration system is required, there is a sufficient volume of stored defrost fluid to ensure adequate defrosting. In an alternative embodiment, the first heat exchanger may provide sufficient storage volume for storage of the defrost fluid.

In one embodiment, where the heat source is the refrigerant condensate, the first heat exchanger may comprise a defrost fluid conduit passing through a refrigerant vessel containing the refrigerant condensate. The refrigerant condensate may come directly from the condenser of the refrigeration system.

In one embodiment the first heat exchanger may be a shell and tube, or shell and plate, heat exchanger. The defrost fluid may pass through the tubes or plates and the heating fluid may pass through (or be disposed in) the shell. Alternatively, the defrost fluid may be disposed in the shell and the heating fluid may flow through the tubes or plates. Other heat exchangers may be employed, such as spiral tube, printed circuit, plate, heat exchangers, etc.

In one embodiment the refrigeration system may comprise a condenser, evaporator and compressor unit. The refrigeration system may further comprise an expansion device, for example, an expansion valve.

In one embodiment the second heat exchanger may form at least part of an evaporator of the refrigeration system. The heated defrost fluid may be able to defrost one or more portions of the evaporator. The defrost fluid may, for example, defrost coils of the evaporator or a drip tray for the evaporator.

In one embodiment a condenser of the refrigeration system may be arranged to transfer heat to heated defrost fluid passing from the first heat exchanger to the second heat exchanger. For example, the condenser may transfer heat to fully, or partially, liquefied defrost fluid (passing from the first to the second heat exchanger) to vapourise the liquefied portion of the defrost fluid. In this respect, heat from the condenser may be used to vapourise the liquefied portion of the defrost fluid, should the heat from sub-cooling the primary refrigerant (in the first heat exchanger) be inadequate to supply sufficient vapourised defrost fluid to effect complete defrost of the evaporator (or other components of the refrigeration system).

In one embodiment the defrost system may comprise a secondary defrost line, and the secondary defrost line may be arranged to allow at least a portion of the defrost fluid to flow from the first heat exchanger to a secondary heat source. The secondary heat source may be one of a solar assembly, water separator, interlaced evaporative condenser, plant room or any other suitable source of waste heat. The secondary heat source may provide heat to the defrost fluid when it has reached equilibrium with the refrigerant condensate in the first heat exchanger (i.e. such that there is no longer any heat exchange from the refrigerant to the defrost fluid). The defrost fluid may, for example, be directed through solar pipes, or may be directed through a further heat exchanger to exchange heat with a heated solar fluid.

In one embodiment the secondary heat source may be the condenser of the refrigeration system. Thus, a portion of the defrost fluid may be routed directly to the condenser (thereby bypassing the defrost fluid vessel).

In one embodiment the refrigeration system may comprise a first stage compressor and second stage compressor. The refrigeration system may further comprise an intercooler connected between the first and second stage compressors.

In one embodiment the intercooler may be in the form of a concentric tube heat exchanger comprising an inner tube and an outer tube. The inner tube may comprise refrigerant passing from the first stage compressor to the second stage compressor, and the outer tube may comprise refrigerant from the first heat exchanger.

The refrigerant may comprise ammonia. Ammonia may be desirable as it can have less impact on the environment when compared to other refrigerants such as hydrofluorocarbons (RFC's), hydrofluoroolefins (HFO's) or hydrochlorofluorocarbons (HCFC's). Ammonia can also have superior thermodynamic properties to other refrigerants and can therefore result in systems with higher energy efficiency. Although ammonia can be hazardous to people, it has a strong odour and therefore ammonia leaks from refrigeration systems can easily be detected. Due to the fact that ammonia is a toxic fluid, minimisation of the ammonia charge of the refrigeration system can reduce risks to operators and the general public. As set forth above, the defrost system disclosed herein can provide a charge reduction (e.g. in two stage compression systems), along with efficiency improvements, thus better suiting an ammonia refrigerant.

In one embodiment the refrigerant vessel may comprise an oil collection outlet. The oil collection outlet may be arranged to collect oil that has separated from the ammonia in the refrigerant vessel. Oil can be used in the compressors of refrigeration system and can then continue through the system with the refrigerant. When the refrigerant reaches the first heat exchanger it may reduce in velocity, such that the oil sinks to the bottom of the first heat exchanger and can be separated from the refrigerant. Collected oil may be returned to the compressor for further use.

In one embodiment the defrost fluid may comprise one of carbon dioxide, ammonia, a hydrocarbon, a hydrofluorocarbon, or a hydrofluorolefin.

Also disclosed herein is a refrigeration system. The system comprises a refrigeration cycle and a defrost cycle separated from the refrigeration cycle. The system further comprises a first heat exchanger configured to exchange heat from a heat source to a defrost fluid of the defrost cycle. The system further comprises a second heat exchanger configured to receive heated defrost fluid from the first heat exchanger, and to exchange heat from the heated defrost fluid to one or more components of the refrigeration cycle to at least partially defrost the one or more components.

In one embodiment the heat source may be a refrigerant of the refrigeration cycle.

The refrigeration system may be as otherwise described above with respect to the defrost system.

Also disclosed herein is a method for defrosting one or more components of a refrigeration system. The method comprises transferring heat from a heat source of the refrigeration system to a defrost fluid to cause the defrost fluid to at least partially change phase; and supplying the heated defrost fluid to the one or more components of the refrigeration system to transfer heat from the defrost fluid to the one or more components so as to at least partially defrost the one or more components.

As set forth above, the (at least partial) phase change of the defrost fluid may result in a change in density of the defrost fluid which can cause the defrost fluid to move from the first heat exchanger to the second heat exchanger. The subsequent loss of heat from the defrost fluid, to the one or more components of the refrigeration system, may result in a further density change of the fluid, that can cause it to move back towards the first heat exchanger from the second heat exchanger.

In one embodiment the heat source may be a refrigerant of the refrigeration system.

In one embodiment the method may further comprise the step of condensing the refrigerant prior to transferring heat from the refrigerant to the defrost fluid.

In one embodiment the step of transferring heat from the refrigerant to the defrost fluid may comprise sub-cooling the refrigerant.

In one embodiment the method may further comprise the steps of compressing the refrigerant in a first compression stage; cooling the refrigerant by way of heat transfer with refrigerant condensate; and then compressing the refrigerant further in a second compression stage.

In one embodiment the method may further comprise the step of temporarily storing the heated defrost fluid prior to supplying the defrost fluid to the one or more components of the refrigeration system.

In one embodiment the method may further comprise the step of storing the defrost fluid after transferring heat from the defrost fluid to the one or more components of the refrigeration system. In one embodiment the step of transferring heat from the refrigerant to the defrost fluid may comprise vapourising the defrost fluid.

In one embodiment the method may further comprise the step of separating oil from the refrigerant while transferring the heat from the refrigerant to the defrost fluid.

In one embodiment the one or more components may comprise an evaporator of the refrigeration system.

In one embodiment the method may further comprise the step of transferring heat from a condenser of the refrigeration system to the defrost fluid prior to supplying the defrost fluid to the one or more components of the refrigeration system.

In one embodiment the heat source may be one of a solar assembly, water separator, interlaced evaporative condenser or plant room.

In one embodiment the refrigerant may comprise ammonia.

In one embodiment the defrost fluid may comprise one of carbon dioxide, ammonia, a hydrocarbon, a hydrofluorocarbon, or a hydrofluorolefin.

The method may be as otherwise described above with respect to the defrost system.

Also disclosed is a further defrost system for defrosting one or more components of a refrigeration system. The defrost system comprises a first heat exchanger configured to exchange heat from a heat source to a defrost fluid, and a second heat exchanger configured to receive heated defrost fluid from the first heat exchanger, and to exchange heat from the heated defrost fluid to the one or more components of the refrigeration system to at least partially defrost the one or more components. The defrost fluid is driven between the first and second heat exchangers by way of a thermosiphon process.

The further defrost system may be as otherwise described above with respect to the defrost system disclosed above.

BRIEF DESCRIPTION OF THE DRAWINGS

Embodiments will now be described by way of example only, with reference to the accompanying drawing in which.

DETAILED DESCRIPTION

Figure 1:
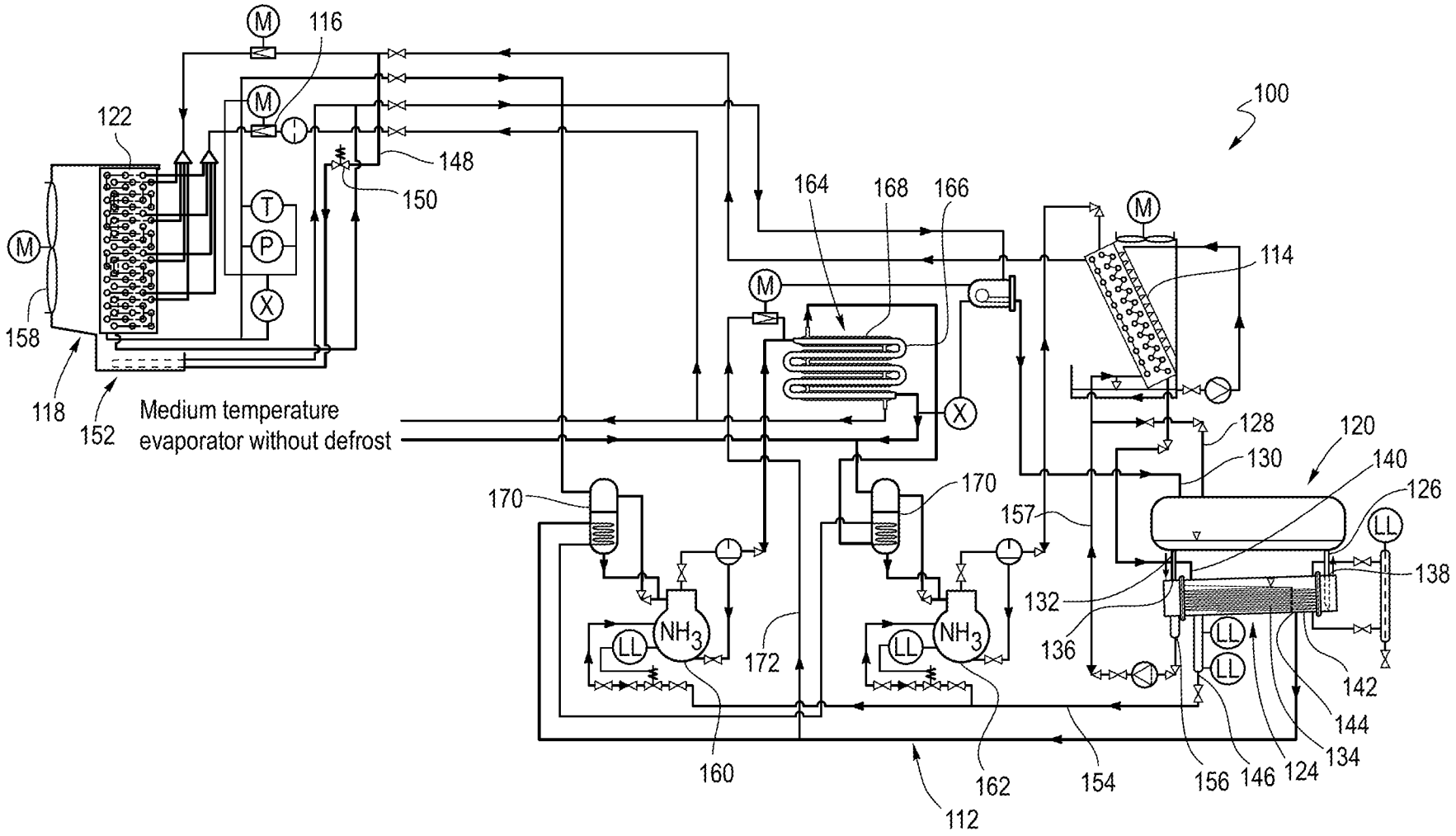
FIG. 1 is a schematic showing a first embodiment of the system.

In the following detailed description, reference is made to accompanying drawings which form a part of the detailed description. The illustrative embodiments described in the detailed description, depicted in the drawings and defined in the claims, are not intended to be limiting. Other embodiments may be utilised and other changes may be made without departing from the spirit or scope of the subject matter presented. It will be readily understood that the aspects of the present disclosure, as generally described herein and illustrated in the drawings can be arranged, substituted, combined, separated and designed in a wide variety of different configurations, all of which are contemplated in this disclosure.

Referring firstly to FIG. 1, the system 100 comprises two separate fluid cycles. The first cycle is a refrigeration cycle making use of a refrigerant and including a compressor 112, condenser 114, expansion valve 116 and evaporator 118. In this embodiment the refrigerant is ammonia ($NH_3$) but it is to be understood that other refrigerants may be used in the system (e.g. HC's, RFC's, HFO's and $CO_2$).

The second cycle is a defrost cycle making use of a defrost fluid (in this case $CO_2$) and including, among other components, a defrost fluid receiver vessel in the form of a defrost tank 120. In other embodiments, different defrost fluids may be used in the system, for example, hydrocarbons, hydrofluorocarbons, hydrofluorelefins, etc. (e.g. the defrost fluid may be $NH_3$).

The defrost and refrigeration cycles exchange heat at two separate locations of the system. A first exchange of heat is between the defrost fluid, in liquid form (i.e. condensate), of the defrost cycle and refrigerant condensate of the refrigeration cycle. This first heat exchange takes place in a first heat exchanger, which in the illustrated embodiment, is in the form of a shell and tube heat exchanger 124. A second exchange of heat occurs between the evaporator 118 of the refrigeration system and a hot gas line 122 of the defrost cycle. More specifically, this second exchange of heat is between frost build-up in the vicinity of the evaporator and other components of the refrigeration cycle, and the hot defrost gas of the defrost cycle.

The defrost tank 120 comprises two inlets and two outlets: a gas inlet 126, a gas outlet 128, a condensate inlet 130 and a condensate outlet 132. The condensate inlet 130 of the tank receives defrost fluid condensate that is formed as a result of the second heat exchange described above (i.e. between the hot defrost gas and the frost build-up on the evaporator of the refrigeration system). In operation, the defrost fluid condensate flows from the tank 120 via the condensate outlet 132 (in this case, driven by gravity) and passes into the tubes 134 of the shell and tube heat exchanger 124 via a defrost fluid condensate inlet 136. In addition to this inlet 136, the shell and tube heat exchanger 124 comprises a defrost gas outlet 138 from the tubes, a refrigeration fluid inlet 140 into the shell 142, a refrigeration fluid outlet 144 from the shell 142, and an oil drainage outlet 146.

The shell 142 of the heat exchanger 124 contains refrigerant condensate, which the tubes 134 of the heat exchanger 124 are, in operation, at least partially immersed in. This refrigerant condensate forms in the condenser 114 of the refrigeration system and is therefore at a generally high temperature and pressure (i.e. relative to refrigerant at other parts of the system). The defrost fluid entering the tubes 134 is cooler than the refrigerant stored in the shell 142 such that heat is transferred from the refrigerant to the defrost fluid (i.e. driven by the temperature differential). This sub-cools the refrigerant and increases the temperature of the defrost fluid in the tubes 134 so as to cause the defrost fluid to increase in pressure and to transition, at least partially, into a gas. The heated defrost fluid rises (due to pressure differentials) and flows from the heat exchanger 124 via the defrost gas outlet. In this way, the defrost fluid re-enters the defrost tank 120 via the defrost gas inlet 126. Hence, flow of the defrost fluid between the heat exchanger 124 and the defrost tank 120 is generally in the form of a thermosiphon (or natural circulation) process. When the defrost and refrigerant fluids in the heat exchanger 124 are at (or close to being at) the same temperature, the process stops. The tubes 134 are on an incline to prevent vapour locks (i.e. where the top tubes 134 fill with vapour, thereby stopping or inhibiting the thermosiphon process).

The defrost gas can be stored in the tank 120 until required to defrost the evaporator 122 of the refrigeration system. When required, the defrost gas can be released from the tank 120 and directed through the condenser 114 (which further heats the defrost gas) to the evaporator 122 of the refrigeration system. A side-stream 148 of gas, controlled by a solenoid valve 150, may pass to the drip tray 152 of the refrigeration system in order to defrost any frost or ice that has built up on and around the drip tray 152. The solenoid valve 150 is opened prior to the main defrost fluid valve feeding the defrost fluid loops (interlaced with the evaporator tubes). This is to pre-heat the drip tray so that any water dripping off the evaporator does not re-freeze in the drip tray. As heat is transferred from the hot defrost gas to the frost build-up on the components of the refrigeration system, the defrost fluid cools and condenses. In this way, the defrost fluid returns to the defrost tank 120 as condensate. This defrost condensate can then cycle through the shell and tube heat exchanger 124 (as discussed above) in preparation for further defrosting.

In the shell and tube heat exchanger 124, the shell 142 contains refrigerant condensate from the condenser 114 of the refrigeration cycle. In addition, the shell 142 contains oil which passes through the refrigeration cycle from the compressor 112. If the refrigerant and oil combination is such that the oil and refrigerant do not mix (i.e. one does not dissolve in the other as usually found in ammonia refrigeration systems), the oil that enters the shell 142 tends to settle towards the bottom of the shell 142 (i.e. due to a decrease in velocity of the refrigerant through the shell 142). The shell 142 is inclined, which directs the settled oil towards the lower end of the shell 142 where the oil drainage outlet 146 is located. The oil captured by the drainage outlet 146 can either be removed from the system or, in this case, can be directed to the compressor 112 via an oil supply line 154, for further use in the system. Thus, the shell 142 of the shell and tube heat exchanger 124 essentially acts as an oil separator (using the density difference between the oil and ammonia) for the refrigeration cycle.

Also in fluid connection with the shell is a secondary heat transfer circuit. In the illustrated embodiment the secondary heat transfer circuit comprises a second defrost fluid outlet 156 in the heat exchanger 124. When the pressure in the tank 120 becomes too low to drive the defrost fluid through the defrost loops 122 in the evaporator 118 and back to the tank 120, a defrost fluid pump forces defrost fluid liquid through the condenser 114 via conduit 157 where it is vapourised (and allows the defrost process to continue operating).

In operation, the refrigerant held in the shell 142 passes from the shell 142, via the refrigeration fluid outlet 144, through the (motorised) expansion valve 116 of the refrigeration system (i.e. so as to lower its pressure and temperature). The refrigerant then passes to the evaporator 122 wherein a fan 158 forces air across the coils of the evaporator 122 (containing the cold refrigerant) to cool a refrigerated space.

The compressor 112 of the refrigeration cycle is in the form of a two-stage compressor arrangement comprising a first stage compressor 160 and a second stage compressor 162 separated by an intercooler 164. The intercooler 164 is in the form of a tube-in-tube (i.e. concentric tube) heat exchanger. The inner tube 166 of this arrangement comprises discharge refrigerant passing from the first stage compressor 160 to the second stage compressor 162. The outer tube 168 comprises refrigeration fluid passing from the refrigeration fluid outlet 144 of the shell and tube heat exchanger 124 to the expansion valve 116. This refrigeration fluid passes, on its way to the intercooler 164, through two compressor heat exchangers 170 where it exchanges heat with fluid entering the first 160 and second 162 stage compressors. A side stream of refrigeration fluid 172, which does not pass through the compressor heat exchangers 170, is injected into the discharge refrigerant from the first stage compressor 160 (prior to it entering the intercooler 164). This side stream of refrigeration fluid 170 cools both the discharge refrigeration fluid (from the first stage compressor 160) and the refrigeration fluid in the outer annulus portion of the intercooler 164 (which has passed through the compressor heat exchangers 170). The cooling of the discharge refrigeration fluid between the first 160 and second 162 stage compressors essentially provides a reduction in the work requirement of the system, increases the overall efficiency of the system, and ensures that the discharge gas temperature of the second stage compressor 162 does not exceed the operating limits of the machine.

In known ammonia refrigeration systems with associated hot gas defrost arrangements the intercooler can be in the form of a tank of refrigerant, into which discharge refrigerant gas passes from the first stage compressor (e.g. a closed coil flash intercooler). The discharge gas is dispersed through perforations in a pipe within the tank and then bubbles up within a pool of liquid refrigerant contained in the tank. The vapour (that has bubbled through the pool of liquefied refrigerant in the tank) is then drawn into the second stage compressor from the top of the intercooler. In these known systems, the hot gas defrost requires that condensate returning from the evaporator (during hot gas defrost operation) is accommodated by the tank. As a result, the intercooler is generally the largest reservoir of liquid refrigerant in these systems. As is set forth above, this can present safety and environmental issues.

Although not illustrated, the refrigerant condensate leaving the intercooler 164 can also be directed to a further evaporator (i.e. in addition to the illustrated evaporator). This evaporator is not serviced by the defrost circuit illustrated in FIG. 1 and described above.

Figure 2:
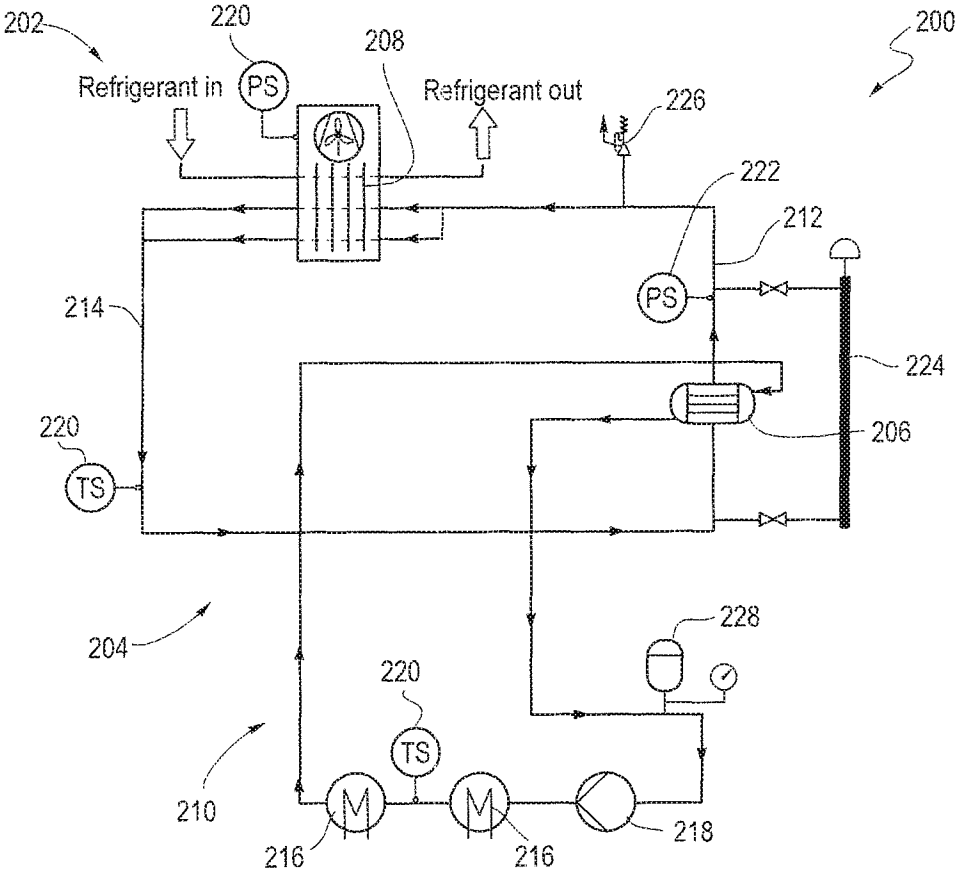
FIG. 2 is a schematic of a second embodiment of the system.

Referring now to FIG. 2, a somewhat less complex variation of the system (than that shown in FIG. 1) is illustrated. Again, this system 200 comprises first and second cycles, which are a refrigeration cycle 202 and defrost cycle 204 respectively, and a first heat exchanger (in the form of a plate and shell heat exchanger 206) and a second heat exchanger (forming part of an evaporator 208). The first heat exchanger 206 exchanges heat between the defrost cycle 204 and a heat source 210, whilst second heat exchanger 208 exchanges heat between one or more components of the refrigeration cycle 202 and the defrost cycle 204. The refrigeration cycle 202 is not illustrated in its entirety; rather, only the portion of the refrigeration cycle 202 that includes the evaporator 208 is shown. As should be apparent to the skilled person, the refrigeration cycle may be in the form of any refrigeration cycle requiring defrosting. The refrigerant of the refrigeration cycle may be e.g. NH3, HC's, HFC's, HFO's or CO2.

The evaporator 208, which comprises the second heat exchanger of the system, is in the form of dual-circuit fin and tube heat exchanger. In addition to forming part of the refrigeration cycle 202, the evaporator 208 also forms part of the defrost cycle 204. In this respect, the evaporator 208 includes two sets of interlaced tubes that separately contain flows of refrigerant and defrost fluid. Although not apparent from the figure, the defrost tubes are arranged on a downward slope (from an inlet to an outlet of the defrost circuit) to direct the flow of defrost fluid towards the outlet of the evaporator 208. In the present embodiment, the defrost fluid of the defrost cycle is $CO_2$ and flows between the evaporator 208 and the plate and shell heat exchanger 206.

The plate and shell heat exchanger 206 is located below the evaporator 208 (but not necessarily directly below). That is, the evaporator 208 is elevated relative to the plate and shell heat exchanger 206. The defrost fluid is located on the shell side of the heat exchanger 206 (although this could be reversed) and the shell is in fluid communication with the evaporator 208 by way of a riser 212 and a dropper 214. The riser 212 extends from the shell of the plate and shell heat exchanger 206 to the evaporator 208, whilst the dropper 214 extends from the evaporator 208 to the shell of the plate and shell heat exchanger 206.

The plate side of the plate and shell heat exchanger 206 is in fluid communication with a (third) heating cycle of the system, which is the heat source 210 that provides heat to the defrost cycle 204. The heating cycle 210 contains a heating fluid which, in this embodiment, is glycol (but could otherwise be e.g. a refrigerant of the refrigeration system). The glycol flows between the plate and shell heat exchanger 206 and two electric heaters 216.

In other embodiments one or more other heat sources may be used (e.g. directly or indirectly via a glycol circuit). For example, when the system forms part of a refrigeration plant in e.g. a freezer room, it may be possible to use waste heat from the refrigeration plant to heat the glycol. This may be performed directly or indirectly. In some freezer rooms a circuit with a water-glycol mixture is used for subfloor heating and, in some further cases, this circuit is heated by waste energy from the refrigeration plant. During a defrost operation of the system, a valve may be used to temporarily divert warm glycol from the subfloor heating system, to the plate and shell heat exchanger.

Other heating means (or sources) may include, for example, solar power or condensate from the refrigeration system (as described above). It should be apparent to the skilled person that the nature of the system 200 is such that any suitable heat source (or combination of heat sources) may be used to provide heat to the defrost fluid in the plate and shell heat exchanger 206. This may include low grade heat sources.

In operation, the electric heaters 216 heat the glycol and a pump 218, forming part of the heating cycle, causing the glycol to flow from the electric heaters 216 and through the plates of the plate and shell heat exchanger 206. At the plate and shell heat exchanger 206, the temperature difference between the warm glycol (in the plates) and the defrost fluid (in the shell) causes heat to be transferred from the glycol to the defrost fluid. This causes at least some of the defrost fluid in the shell to undergo a phase change (or transition) e.g. from a liquid to a vapour (or vapour-liquid mixture) so as to reduce in density. That is, at least some of the defrost fluid in the shell of the plate and shell heat exchanger 206 evaporates due to heat transfer from the heat source 210 (i.e. the heated glycol cycle).

The defrost fluid that undergoes this phase change rises through the riser 212 from the plate and shell heat exchanger 206 due its buoyancy relative to its environment (i.e. due to a reduction in the density of the evaporated defrost fluid). Because the evaporator 208 is elevated relative to the plate and shell heat exchanger 206, the rising defrost fluid flows along the riser 212 and into the defrost tubes (forming the defrost) circuit of the evaporator.

The defrost fluid (after being heated by the heat source 210) is at a higher temperature than frost (i.e. when this is built up on the evaporator), which causes the frost to melt (i.e. by way of heat transfer between the defrost fluid and the frost). In other words, heat is transferred from the defrost cycle 204 to the frost. This loss of heat (from the defrost fluid) causes the defrost fluid to at least partially condense.

In some arrangements, condensation may rapidly occur across the entire (or most of) the inner surface of the evaporator 208 tubes containing the defrost fluid so as to provide a rapid transfer of heat through these surfaces. That is, as the defrost fluid comes into contact with the empty and cold defrost tubes of the evaporator 208 (i.e. at the start of a defrost process) there may be a rapid transfer of heat from the defrost fluid to all of the internal surfaces of the defrost tubes of the evaporator 208. This heat transfer process will generally take place at the same (condensing) temperature throughout. Defrost fluids that do not change phase may not be able to provide this rapid transfer of heat. In this way, and in some arrangements, the phase change of the defrost fluid can result in a more efficient transfer of heat from the defrost fluid to the frost on the evaporator 208 and it can reduce the temperature differential required between the defrost fluid and the melting frost (i.e. when compared with systems in which the defrost fluid does not change phase during the defrost process).

The condensation of the defrost in the defrost tubes of the evaporator 208 may (in some arrangements) also result in a high film (or heat transfer) coefficient. In some embodiments this could be above 10,000 $W/m^2K$ depending on heat flux, temperature, type of fluid and tube diameter. Such a high film coefficient may be difficult (or impossible) to achieve with non-phase change defrost fluid arrangements (e.g. warm glycol). Thus, in such cases, higher grade heat or longer defrost times may be necessary in order to provide acceptable results.

As the defrost fluid condenses, it increases in density. This increase in density, and the sloped nature of the tubes in the evaporator 208 (and the dropper 214) causes the defrost fluid to flow from the evaporator 208, so as to return to the plate and shell heat exchanger 206. The slope of the defrost tubes of the evaporator 208, and of the dropper 214 may also help to prevent liquid hold ups.

As should be apparent, the flow of the defrost fluid in the defrost cycle 202 is largely driven by changes in the aggregate state of the defrost fluid. In some cases (but not always) the temperature of the defrost fluid may remain constant (or approximately constant) throughout the defrost cycle 202 (i.e. as it changes state). A density decrease of the defrost fluid, due to the defrost fluid vapourising in the plate and shell heat exchanger 206, results in flow towards the evaporator 208. Subsequently, a density increase of the defrost fluid, due to condensation of the defrost fluid in the evaporator 208, results in the defrost fluid flowing back to the plate and shell heat exchanger 206. In this respect, the defrost fluid is generally driven around the defrost cycle 202 by a thermosiphon (or natural circulation) mechanism. As may be apparent, this mechanism is facilitated by the elevated positioning of the evaporator 208 relative to plate and shell heat exchanger 206.

In addition to efficiency benefits that may (in some arrangements) be provided by such a mechanism, the presence of the thermosiphon mechanism may result in a self-managing or self-correcting system. As is described above, the thermosiphon mechanism is predominantly driven by changes in the density of the defrost fluid as it flows around the defrost cycle 202. These changes are (mostly) due to a temperature differential between the glycol in the plate and shell heat exchanger 206, and the frost that is formed on the evaporator 208. Hence, when this temperature difference reduces in magnitude, the driving force for the thermosiphon process is also reduced, such that the flow of defrost fluid through the defrost cycle 202 slows. In operation, this reduction in temperature difference happens due to the frost on the tubes or coils of the evaporator 208 melting. Once the frost is completely melted, there is no longer a temperature difference (within the evaporator 208) to drive heat transfer between the defrost fluid the walls of the defrost tubes. In other words, once there is no frost, minimal (or no) heat is transferred from the defrost fluid and therefore the defrost fluid does not condense any further (or condenses to a limited extent). Thus, the density of the defrost fluid in the evaporator 208 is no longer significantly different to that in the plate and shell heat exchanger 206, and there is no longer a driving force to drive the defrost fluid between the evaporator 208 and the plate and shell heat exchanger 206.

In this way, the defrost system 200 may (in a self-managed manner) only operate when defrosting of the refrigeration tubes (and other portions) of the evaporator 208 is required. Such an arrangement may be particularly suited to systems using a low-cost (e.g. waste) heat source that is continually present. It should be apparent that this thermosiphon mechanism is not limited to the presently described embodiments, and that other embodiments may make use of such a mechanism to drive the defrost fluid through the defrost cycle 202.

The system includes other components not described above. Temperature sensors 220 are located on the dropper 214, the evaporator 208 and the heating cycle (at the electric heaters 216) to measure the temperature of the respective fluids at those locations. A pressure sensor 222 is located on the riser 212 to measure pressure of the evaporated defrost fluid. A level sensor 224 is located at the plate and shell heat exchanger 206 to measure the level of the defrost fluid in the shell.

Other than sensors, the system includes a safety relief valve 226 on the riser 212 of the defrost cycle 202. This relieves pressure in the system 200 when it rises above a safe limit. The heating cycle 210 includes an expansion vessel 228 that allows for expansion of the glycol in the heating cycle.

A non-limiting example of the system and method will now be described.

Example

Testing was performed on a test assembly including a defrost system and a refrigeration system, similar to that described above and shown in FIG. 2.

The test assembly included a dual circuit fin and tube evaporator which was located within an air duct. Ammonia (R717) was used as a refrigerant in the refrigeration system and carbon dioxide (R744) as the defrost fluid in the defrost system. A plate and shell heat exchanger was positioned below the evaporator. The heat exchanger contained carbon dioxide on the shell side and a 50% by weight ethylene glycol-water mixture on the plate side. In this way, the defrost circuit of the dual circuit evaporator represented a heat sink and the plate and shell heat exchanger represented a heat source.

The test assembly included temperature and pressure sensors, a liquid level sensor, sight glasses, flexible tubes, service, check and safety relief valves integrated into the carbon dioxide circuit.

The plate side of the heat exchanger was supplied by a glycol circuit. This glycol circuit included the plate side of the plate and shell heat exchanger, a pump and two electrical heaters. These electrical heaters were controlled by a PID temperature controller combined with a phase controlled modulator to keep the glycol temperature constant. This allowed the supplied energy to be logged.

The test assembly also included a lockable bypass around the heat exchanger. Before the defrost process started, the glycol flowed through this bypass. By opening a valve the glycol was able to flow through the heat exchanger, which commenced the defrost process.

Further inclusions in the test assembly were temperature sensors, a safety temperature limiter, an expansion vessel, a breather and manually operated valves.

For the purpose of performing the testing procedure, the dual circuit evaporator was run in cooling mode until the air pressure drop increased from approximately 50 Pa (at which no frost layer was present) to 200 Pa (at which a frost layer was present). The circuit was filled with a $CO_2$ quantity of 14.25 kg at a volume of 31.66 $dm^3$. The heaters of the humidifier were turned on and off to introduce moisture. Care was taken to ensure that the air inlet temperature remained below −1° C. Whilst the cooling mode was activated, the glycol pump was maintained in an operating condition, such that there was a decrease in temperature of the $CO_2$ and glycol.

Refrigerant (R717) in the refrigeration circuit of the evaporator was removed from the system until the pressure decreased to 109 kPa in the refrigerant injection line and 98 kPa in the refrigerant suction line. At this point, the fan and the refrigeration plant were turned off.

Subsequently, the evaporator was shut off and the air duct was closed at a distance of approximately 0.4 m from the air outlet and 5 m from the air inlet. This separated the humidifier tub, fan and all other heat exchange equipment of the air duct from the evaporator.

The bypass around the plate and shell heat exchanger was opened and the electrical heaters were controlled to heat up the glycol to a temperature of 15° C. Following this, the defrost was started by closing a bypass (bypassing the plate and shell heat exchanger), such that glycol at temperature of 15° C. was supplied to the plate and shell heat exchanger.

Figure 3:
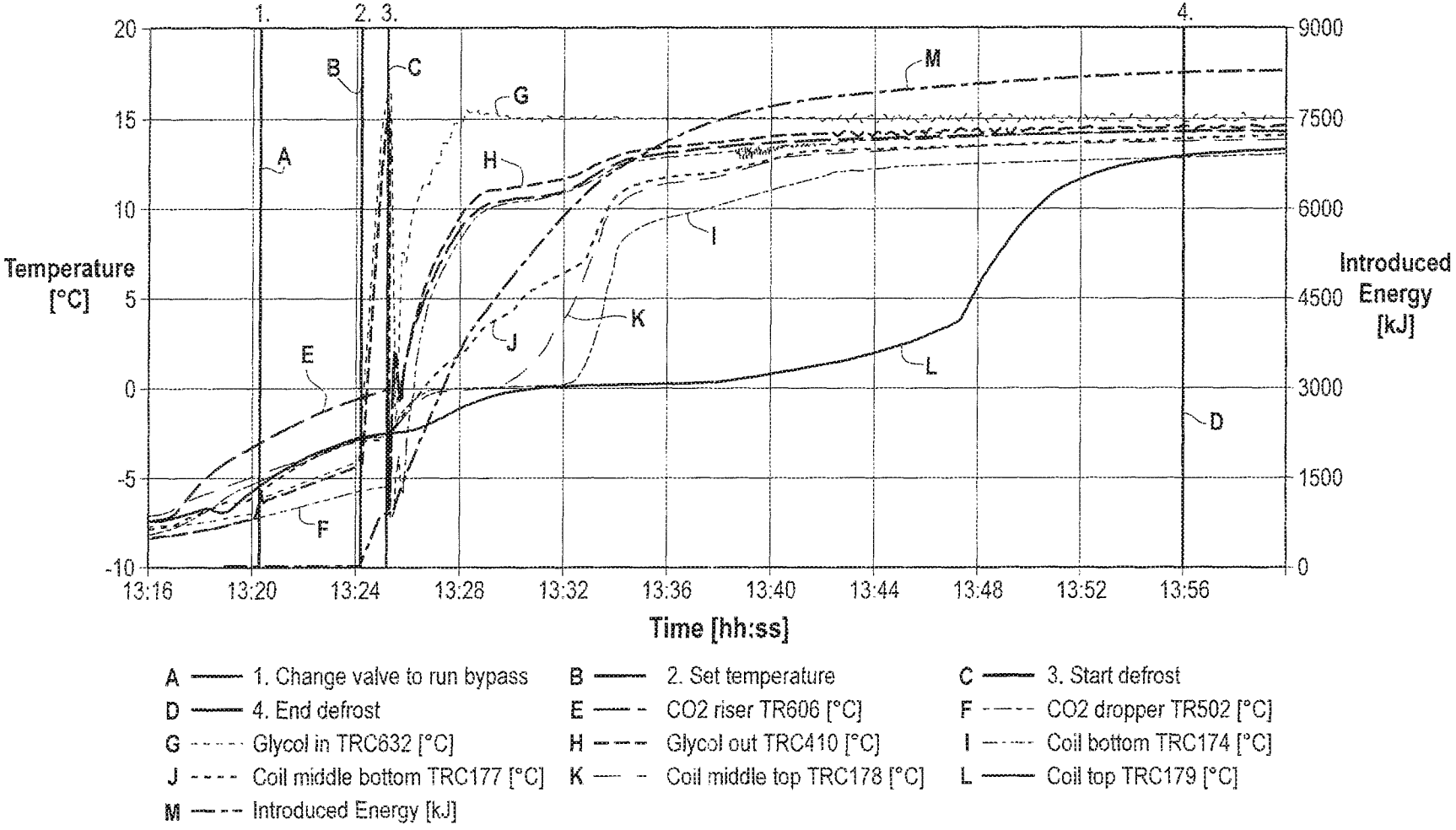
FIG. 3 is a graph showing the results of a test performed on a test assembly.

The results of this test are shown in FIG. 3. The maximum heat capacity of the electric heaters was 20 kW. Due to a large temperature difference between $CO_2$ and the glycol at the beginning of the defrost process, the capacity of the plate and shell heat exchanger was higher than 20 kW. After 1:30 minutes the capacity of the heat exchanger had reduced to a level whereby the inlet temperature of the glycol was maintained at 15° C. During the first 2 minute period of the test, the $CO_2$ temperatures rose sharply from approximately −5.5° C. to 10.5° C., which resulted in the some frost being melted.

Three of four temperature sensors mounted at the evaporator coil indicated temperatures above 8° C. after a period of 8 minutes. The remaining temperature sensor did not indicate a temperature above 8° C. It was believed that the reason for this was a refrigeration pipe in proximity to that temperature sensor. After 8 minutes, the majority of the frost on the evaporator coils had been melted. During the defrost process 9.82 kg of water (i.e. from melted frost) was collected. The amount of energy introduced into the system was 7514 kJ. Of this energy that was introduced, 6560 kJ was used to melt the frost and heat up the components, and 954 kJ remained in the glycol and $CO_2$.

It was apparent from the results and from observations made during the test that, for the first 9 minutes of the test, the $CO_2$ was driven by a continuous thermosiphon mechanism. After the first 9 minutes, the flow of $CO_2$ changed to a pulsating (rather than continuous) circulation.

A further test was performed on the same test assembly. In this test, the glycol temperature was 7° C. and a charge of 14.25 kg was provided to the system. Although initial coil temperatures were high due to exposure to ambient air, a short period of time after the defrost process began, the temperature of the evaporator coils increased. Sight glasses and temperature graphs indicated that the $CO_2$ was again driven by a thermosiphon mechanism. In this respect, this further test showed that operation of the system can be viable with low grade heat sources (e.g. subfloor systems, evaporative condenser sumps, heat from external environment, etc.).

Variations and modifications may be made to the parts previously described without departing from the spirit or ambit of the disclosure.

For example, the defrost systems of the above embodiments serve a single evaporator. In other embodiments, one defrost system may serve multiple evaporators. This may be facilitated by way of solenoid valves that redirect defrost fluid to one or more evaporators.

The embodiments described above may be particularly suited for defrosting components of refrigeration systems. However, the skilled person should recognise that the defrost systems described herein may be suited for use in defrosting various other equipment or structures.

In some embodiments it may be possible to drive the defrost fluid between the first and second heat exchangers by way of a thermosiphon effect, process or mechanism, without a partial phase change of the defrost fluid in the first heat exchanger.

In the claims which follow and in the preceding summary except where the context requires otherwise due to express language or necessary implication, the word "comprising" is used in the sense of "including", that is, the features as above may be associated with further features in various embodiments.

The invention claimed is:

1. A defrost system for defrosting one or more components of a refrigeration system, the defrost system comprising:

a first heat exchanger configured to exchange waste heat from a heat source to a defrost fluid to cause the defrost fluid to be heated and to undergo at least a partial phase change; and a second heat exchanger comprising:

a defrost conduit for receiving the defrost fluid that has been heated and has undergone the at least partial phase change; and a refrigerant conduit for refrigerant of the refrigeration system, wherein the refrigerant conduit and the defrost conduit are arranged so that heat flows from the defrost fluid, which is in the defrost conduit that has been heated and has undergone the at least partial phase change, to the refrigerant conduit and to the refrigerant within the refrigerant conduit to at least partially defrost the refrigerant conduit.

2. The defrost system as claimed in claim 1, wherein the defrost fluid is at least partially vaporized in the first heat exchanger.

3. The defrost system as claimed in claim 1, wherein the defrost fluid that has been heated, has undergone the at least partial phase change, and is received in the defrost conduit of the second heat exchanger is in the form of:

a mixture of saturated vapor and liquid; or saturated vapor.

4. The defrost system according to claim 1, wherein thermodynamic interaction between the defrost conduit and the refrigerant conduit causes the defrost fluid within the defrost conduit to undergo a second at least partial change in phase in the second heat exchanger by at least partially condensing in the defrost conduit of the second heat exchanger.

5. The defrost system according to claim 1, wherein the defrost fluid circulates between the first heat exchanger and the second heat exchanger as a result of density changes in the defrost fluid.

6. The defrost system according to claim 1, wherein the heat source comprises a heating fluid flowing through the first heat exchanger, the heating fluid being at least partially heated by waste heat from the refrigeration system, and wherein the heating fluid is a refrigerant of the refrigeration system that is an optionally subcooled condensate.

7. The defrost system according to claim 1, further comprising an intermediary defrost fluid vessel for storage of defrost fluid, the intermediary defrost fluid vessel in fluid communication with, and between, the first and second heat exchangers.

8. The defrost system according to claim 1, wherein the second heat exchanger forms at least part of an evaporator of the refrigeration system, the defrost fluid that has been heated, has undergone the at least partial phase change, and is within the defrost conduit is able to defrost one or more portions of the evaporator.

9. The defrost system according to claim 1, wherein a condenser of the refrigeration system is arranged to transfer heat to heated defrost fluid flowing from the first heat exchanger to the second heat exchanger.

10. The defrost system according to claim 1 further comprising a second defrost conduit, the second defrost conduit arranged to allow at least a portion of the defrost fluid to flow from the first heat exchanger to a separate second heat source selected from the group consisting of a solar assembly, a water separator, an interlaced evaporative condenser, and a plant room.

11. The defrost system according to claim 1 further comprising a second defrost conduit, the second defrost conduit arranged to allow at least a portion of the defrost fluid to flow from the first heat exchanger to a separate second heat source that comprises a condenser of the refrigeration system.

12. The defrost system according to claim 1, wherein the refrigeration system comprises a first stage compressor, a second stage compressor and an intercooler connected between the first stage compressor and the second stage compressor.

13. The defrost system according to claim 12, wherein the intercooler is in the form of a concentric tube heat exchanger comprising an inner tube and an outer tube, and wherein the inner tube comprises refrigerant passing from the first stage compressor to the second stage compressor, and the outer tube comprises refrigerant from the first heat exchanger.

* * * * *